United States Patent [19]

Ramon

[11] 4,280,696

[45] Jul. 28, 1981

[54] JAW AND FACIAL MUSCLE EXERCISER

[76] Inventor: Yoav Ramon, 425 N. Edinburgh Ave., Los Angeles, Calif. 90048

[21] Appl. No.: 42,460

[22] Filed: May 25, 1979

[51] Int. Cl.[3] ..... A63B 23/00

[52] U.S. Cl. ..... 272/95; 272/140

[58] Field of Search ..... 272/95, 94, 137, 140, 272/67, 68, 55, 116; 128/17

[56] References Cited

U.S. PATENT DOCUMENTS

| | | | |
|---|---|---|---|
| 1,389,436 | 8/1921 | Cameron | 272/95 X |
| 1,714,029 | 5/1929 | Kuhn | 272/95 |
| 1,851,865 | 3/1932 | Ptacek | 272/95 |
| 2,806,699 | 9/1957 | Spooner | 272/140 |
| 3,807,729 | 4/1974 | Sigma | 272/68 |
| 3,813,096 | 5/1974 | Welch | 272/95 |

FOREIGN PATENT DOCUMENTS

| | | | |
|---|---|---|---|
| 11906 | 5/1912 | United Kingdom | 272/68 |

*Primary Examiner*—George J. Marlo

*Attorney, Agent, or Firm*—Robert J. Schaap

[57] ABSTRACT

An exerciser apparatus for enabling exercising of facial muscles and jaws through movement of the jaws. The apparatus comprises a pair of flat spring arms which are pivotally connected to each other by 360° convolutions which form a torque spring. The upper arm is provided with a receptacle or similar member to receive the upper teeth or gingiva and another receptacle or similar member is provided on the other of the arms to receive the lower teeth or gingiva. The torque spring biases the arms in a first direction and the user attempts to squeeze the arms together at one end against the action of the biasing mechanism.

3 Claims, 6 Drawing Figures

JAW AND FACIAL MUSCLE EXERCISER

BACKGROUND OF THE INVENTION

1. Field of the Invention

This invention relates in general to new and useful improvements in muscle exerciser apparatus, and more particularly, to jaw and facial muscle exerciser apparatus in which a user employs force from the jaws to squeeze a pair of arms against the actions of a biasing means.

2. Brief Description of the Prior Art

In recent years, there has been a number of innovations in exercising apparatus to enable people to utilize various body muscles in a capacity in which they would otherwise not be exercised. However, very little, if anything at all has been done in this area in order to permit people to exercise jaw and facial muscles.

It has been recognized that exercising facial muscles and particularly, jaw muscles, is highly beneficial for persons who have sustained jaw injuries. More importantly, it has also been recognized that exercising of jaw muscles and other facial muscles will have a tendency to decrease fatness beneath the chin of the human being. Consequently, facial muscle exercising has a tendency to actually increase the appearance of the individual by decreasing not only the fatness, but the wrinkles in the chin. Even moreso, it has been found that the muscles which are strained by movement of the jaw when properly exercised, will decrease wrinkles around the eyes, due to the fact that it will cause a conditioning of the skin in the area around the eyes.

It has also been recognized that certain people have a tendency to grind their upper and lower teeth inadvertently as a result of tension or other emotional strain. This grinding of the teeth, while utilizing muscle activity, is not really effective in exercising jaw muscles inasmuch as the action which is created is only a sliding or grinding action between upper and lower molar teeth. However, there has been some theory that this situation could be aleviated somewhat by at least exercising jaw muscles.

OBJECTS OF THE INVENTION

It is, therefor, a primary object of the present invention to provide a jaw and facial muscle exerciser apparatus in which a user can exercise jaw and facial muscles by squeezing on a pair of arms with the teeth or gingiva against the action of a biasing means.

It is another object of the present invention to provide an exerciser apparatus of the type stated in which the apparatus includes a pair of arms pivoted on a pivot means and which also includes means to receive the upper and lower teeth or gingiva in order to permit a squeezing action against a spring mechanism.

It is a further object of the present invention to provide an apparatus of the type stated which is highly effective in its operation and which can be constructed at a relatively low unit cost.

It is an additional object of the present invention to provide a method of exercising facial muscles through movement of facial jaws which involves the alternate squeezing and releasing of pivotally connected arms toward each other against the action of a biasing means.

It is another salient object of the present invention to provide a method of the type stated which can be used by people of all ages.

With the above and other objects in view, my invention resides in the novel features of form, construction, arrangement and combination of parts presently described and pointed out in the claims.

SUMMARY OF THE DISCLOSURE

The present invention relates to an exerciser apparatus for enabling the exercising of facial muscles through movement of jaws, and more particularly exercising of jaw muscles through the movement of jaws. The exerciser apparatus of the present invention comprises a first arm along with a second arm which is pivotably connected to the first arm. A pivot means extends between the first and second arms at a pivot point in order to form opposed first and second arm portions which can be engaged by the teeth or gingiva of a user.

The apparatus also includes a biasing means, preferably in the form of a spring means, which causes the arms to move in a first direction about a pivot point to a first position. The arms can remain in the first or unactuated position when not engaged by the teeth or gingiva of a user. Moreover, when the user attempts to move the arms away from the first position by engaging the arms with the teeth or gingiva, and through a squeezing action the user moves these arms in a second direction against the action of the biasing means thereby moving portions of the arms together.

In a more preferred aspect, a first engaging element, generally in the form of an arcuately shaped receptacle sized and shaped to receive the upper teeth or upper gingiva is located on the end of one of the arms. A second engaging element is located on the end of the other of the arms and is also an arcuately shaped receptacle sized and shaped to receive the teeth or the gingiva on the lower jaw.

The first and second directions are generally opposite to each other. The user of the apparatus attempts to squeeze the ends of the arms, which have the arcuately shaped receiving members, toward each other. The arcuately shaped engaging elements, as indicated above, generally conform to the size and shape of the teeth or gingiva. The spring means in one embodiment of the invention is compressed when the two engaging elements are squeezed together. However, in another embodiment of the invention, the biasing means is a spring means which is expanded when the two engaging elements are squeezed together.

In the method of the present invention, the user engages the first receptacle on one of the arms with the upper teeth or gingiva and engages the receptacle on the other of the arms with the lower teeth or gingiva. The user then alternately squeezes the receptacles toward each other against the action of the biasing means by applying forces to the receptacles from the muscles in the region of the jaw and also releases the forces through alternate opening and closing of the jaws.

This invention possesses many other advantages and has other purposes which may be made more clearly apparent from a consideration of forms in which it may be embodied. These forms are shown in the drawings accompanying and forming part of the present specification. They will now be described in detail for the purposes of illustrating the general principals of the present invention; but it is to be understood that such detailed descriptions are not to be taken in a limiting sense.

BRIEF DESCRIPTION OF THE DRAWINGS

Figure 1:
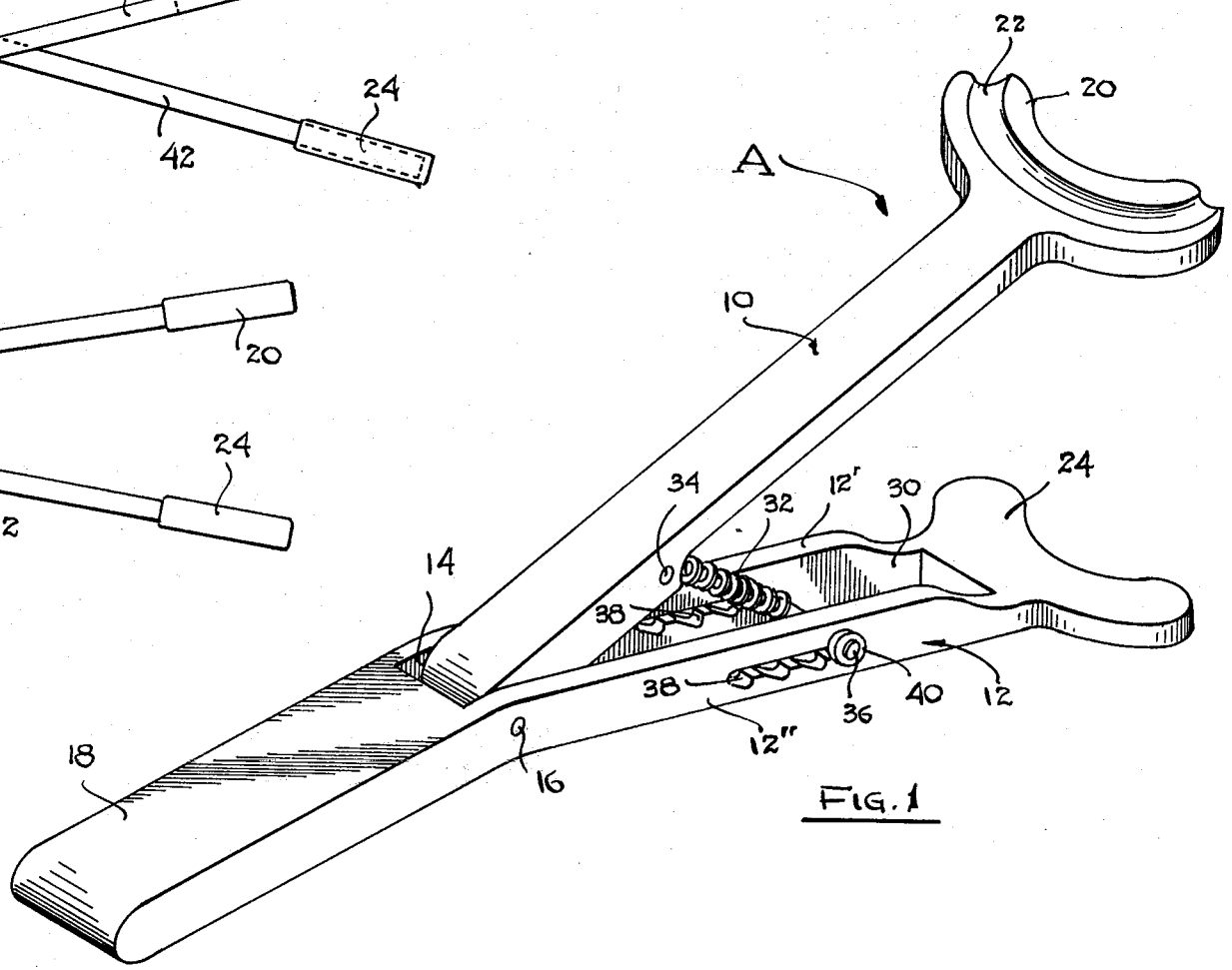
Figure 4:
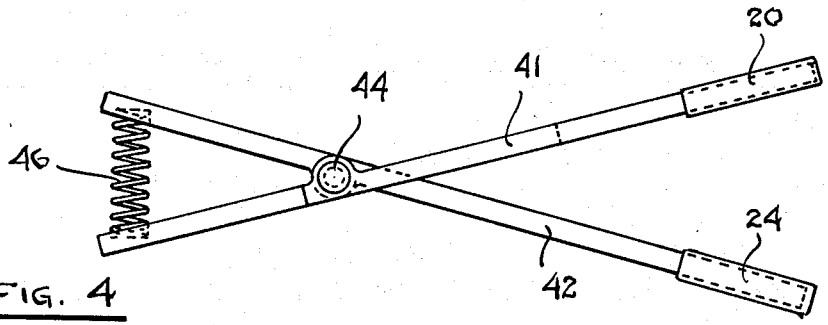
Figure 5:
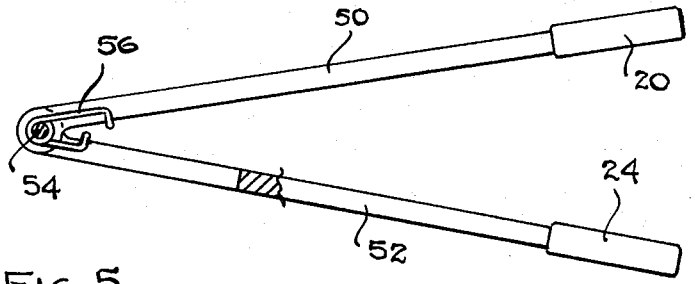
Figure 2:
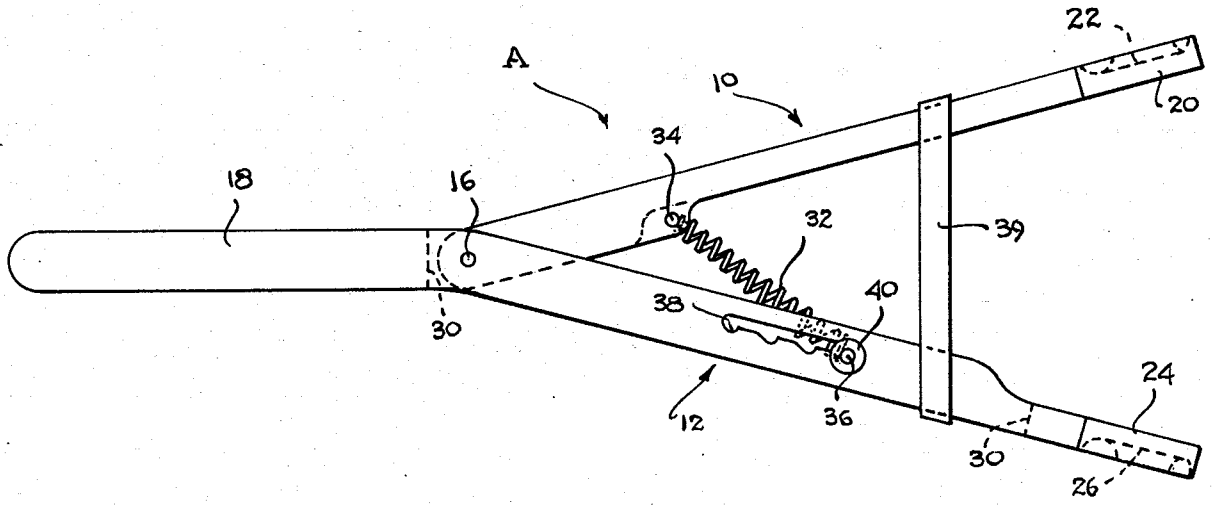
Figure 3:
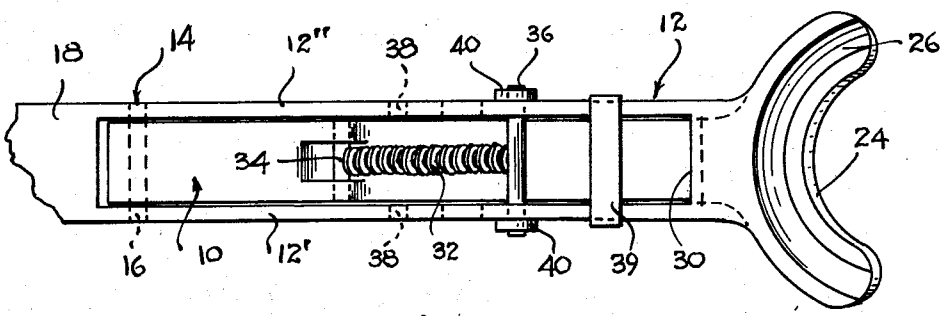
Figure 6:
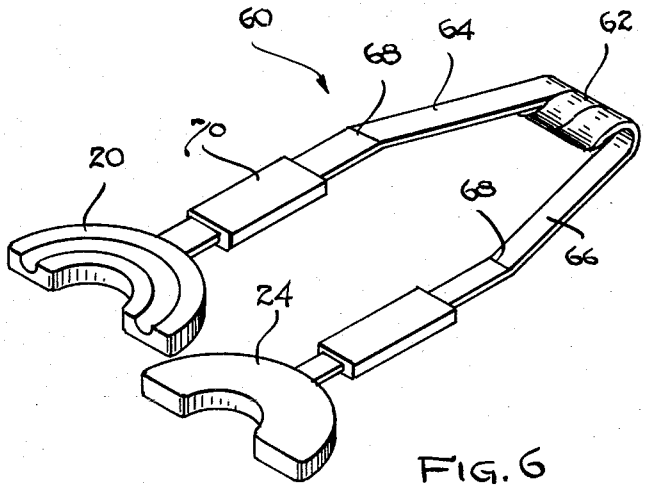

Having thus described the invention in general terms, reference will now be made to the accompanying drawings in which:

FIG. 1 is a perspective view of a jaw and facial muscle exerciser apparatus constructed in accordance with and embodying the present invention;

FIG. 2 is a side elevational view of the exerciser apparatus of the present invention;

FIG. 3 is a bottom plan view of the exerciser apparatus of FIG. 1;

FIG. 4 is a schematic side elevational view of another embodiment of the exerciser apparatus of the present invention;

FIG. 5 is a schematic side elevational view of a further embodiment of the exerciser apparatus of the present invention; and FIG. 6 is a schematic perspective view of still a further embodiment of the exerciser apparatus of the present invention.

DETAILED DESCRIPTION OF PREFERRED EMBODIMENT

Referring now in more detail and by reference characters to the drawings which illustrate practical embodiments of the present invention, A designates a jaw and facial muscle exerciser generally comprising a first arm 10 constituting an upper arm and a lower arm 12 constituting a lower arm and which are connected at a pivot point 14 by means of a pivot pin 16. In this embodiment of the invention, the apparatus A is comprised of an outwardly extending handle 18, in the manner as illustrated in FIGS. 1–3 of the drawings. Furthermore, in the embodiment of the invention as illustrated, the handle 18 is integral with the lower of the arms 12.

By further reference to FIGS. 1–3, it can be observed that the handle 18 is angularly disposed to the lower arm 12, much in the manner as illustrated. Further, it can be observed that the handle 18 extends in a generally horizontal plane whereas the upper and lower arms 10 and 12, respectively, diverge outwardly away from one end of the handle 18. In this embodiment of the invention, the upper arm 10 is essentially pivotal in the lower arm 12 or in an integral extension of the lower arm 12.

The upper arm 10 is integrally provided at its outer end with a somewhat arcuately shaped receptacle 20, often referred to as an engaging element. The receptacle 20 is provided with a pad 22 having an upper bitting surface sized and shaped to receive the teeth or gingiva of a human being. In like manner, the lower arm 12 is provided at its outer end with an integrally formed somewhat arcuately shaped receptacle or engaging element 24. In like manner, the receptacle 24 is provided on its underside with a pad 26 having a lower surface for receiving the lower teeth or gingiva of a human being utilizing the exerciser apparatus of the present invention.

In the embodiment as illustrated, the somewhat arcuately shaped receptacles 22 and 24 are integrally formed with respective arms 10 and 12. However, it should be understood these members could be formed separately and attached to the arms 10 and 12, respectively. Moreover, in the embodiment of the invention as illustrated, many of the components, e.g., the arms 10 and 12 for example, and with perhaps the possible exception of the spring, may be formed of a number of known plastic materials as for example, polyethylene, polystyrene, polybutadiene or the like. Moreover, these components can be formed in a number of known conventional molding operations as for example, thermoforming, blow molding, injection molding, or the like.

Notwithstanding any of the above, it should be understood that many of the aforesaid components of the present invention including the arms could be formed other structural materials including wood, various metals, such as aluminum, or the like. Further, these components could be formed of reinforced plastics as for example, the glass epoxy resins or other fiber-resin composites including carbon, boron and the like.

The receiving members 20 and 24 are preferably made from a hard rubber or other form of elastic material which allows the user to bite firmly on one end of each of the arms. In this case, many hard rubbers as for example, neoprene rubbers or the like may be employed. In like manner, many rubbers, often referred to as plastics, such as polyurethanes and the like could also be employed as the pads 22 and 26 or so-called mouth pieces on the upper and lower arms 10 and 12, respectively. Notwithstanding the above, any material which is capable of receiving the teeth or gingiva could be utilized on ends of the arms or at least in close proximity to the ends of the arms.

In the embodiment of the invention as illustrated, in FIGS. 1–3, the upper arm 10 is pivoted within a recess of 30 formed in the lower arm 12. Specifically, the lower arm 12 includes a pair of spaced apart arm portions 12' and 12" which are connected to the handle 18 and these spaced apart arm portions integrally merge into the receptacle 24. In the embodiment of the invention as illustrated in FIGS. 1–3, the upper arm 10 is biased away from the lower arm 12 by means of a compression spring 32 which is connected to the upper arm 10 by means of a pin 34. Further, the compression spring 32 is also connected to a pin 36 extending between the arm portions 12'and 12" as illustrated in FIG. 1.

The arm portions 12' and 12" include a plurality of longitudinally spaced apart transversely extending grooves 38 in order to receive the pin 36. Mounted on the outer ends of the pin 36 are retaining washers 40. In this way, by positioning the pin 36, it is possible to increase the amount of tension through which the upper arm 10 is biased away from the lower arm 12.

In accordance with the above outline construction, the user can set the desired amount of tension required in order to squeeze the two mouth pieces 22 and 26 together by shifting the pin 36 to the desired position. Thus, if the user wishes to set a greater amount of tension in the device, the pin 36 will be pushed to one of the recesses 38 to the left. In like manner, if the user wishes to reduce the amount of tension, and hence the amount of force required to squeeze the two mouth pieces together, the user may push the pin 36 to the right, reference being made to FIG. 1.

A continuous somewhat flexible strap 39 extends around the two arms 10 and 12 and serves to limit the movement of the two receptacles 20 and 24. The strap 39 may be secured at its upper end to the arm 10 and at its lower end to the arm 12. In this way, when the user squeezes the receptacles 20 and 24 toward each other, the vertically disposed portion of the strap 39 will be relaxed in the same manner as a flexible cloth, although it will define the outer limits of movement of the receptacles 20 and 24. The strap 39 thereby effectively reduces the possibility of injury to the teeth or gingiva if the receptacles 20 and 24 should snap apart.

FIG. 4 illustrates another embodiment of the invention, which is similar to FIG. 1, except the embodiment of the invention in FIG. 4 comprises a pair of cross arms 41 and 42 which are connected by means of a pivot pin 44 much in the same manner as the arms 10 and 12 are connected. However, the arms 41 and 42 extend beyond the pivot pin 44 and are connected at their outer ends by means of a compression spring 46. At their other ends, the arms 41 and 42 are provided with the receptacles in the form of mouthpieces, as for example, the receptacles 20 and 24.

This embodiment of the invention as illustrated in FIG. 4 is similar to the previously described embodiment. In this way, when the user attemps to squeeze the two mouthpieces 22 and 26 together, the user will squeeze against the action of the spring 46 which will thereupon compress. After squeezing the two mouthpieces toward each other, the spring 46 will then thereupon bias the two mouthpieces 22 and 26 apart to the position as illustrated in FIG. 4. It should be understood that with slight modification of the arms, the device of FIG. 4 could utilize and operate with a tension spring.

FIG. 5 illustrates another embodiment of the invention in which a pair of arms 50 and 52 are connected at one end by means of a pivot pin 54. At their opposite ends, which are spaced apart from each other and in their relaxed position, the arms are provided with mouthpieces 20 and 24 much in the manner as previously described. In this embodiment of the invention, a torsion spring 56 is wrapped around the pivot pin and connected to the two arms 50 and 52 as illustrated. In this way, the torsion spring 56 tends to bias the opposite ends of the two arms which contain the mouthpieces 20 and 24 to the open position as illustrated. This embodiment of the invention operates similar to the previously described embodiments in that the user merely attempts to alternately squeeze the two mouthpieces 20 and 24 together against the action of the spring 56. The spring thereupon alternately biases the two mouthpieces 20 and 24 apart to the position as illustrated in FIG. 5.

FIG. 6 illustrates a further embodiment of the invention in which a band of metal 60 which has some resiliency can be wrapped in convolutions intermediate its ends to form a torsion spring 62 with the remaining portions of the band extending outwardly as a pair of arms 64 and 66 which are integrally connected at their ends by the torsion spring 62. At their opposite ends, which are spaced apart from each other and in their relaxed position, the arms are provided with mouth pieces 20 and 24 much in the manner as previously described. In this embodiment of the invention, a separate torsion spring is not required to connect the two arms 64 and 66. Thus, the resiliency of the metal band 60 enables the convolutions to function as a coil spring integral with the arms and the torsion spring 62 will bias the opposite ends of the two arms 64 and 66 which contain the mouth pieces 22 and 24 to the open position as illustrated.

Inasmuch as the convolutions forming the spring 62 may tend to separate the arms 64 and 66 bends 68 can be formed in the arms to be disposed in vertical alignment. Further, since the width of the arms 64 and 66 may be somewhat narrow to permit the convolutions to be formed, reinforcing plastic sleeves 70 may be disposed over portions of the arms 64 and 66 as illustrated.

This embodiment of the invention in FIG. 6 operates similar to the previously described embodiments in that the user merely attempts to alternately squeeze the two mouth pieces 20 and 24 together against the action against the spring 62. The spring thereupon alternately biases the two mouth pieces 20 and 24 apart to the position as illlustrated in FIG. 6.

Thus, there has been illustrated and described a unique and novel jaw and facial muscle exerciser operable by forces applied through the jaw and facial muscles and which therefore fulfills all of the objects and advantages sought therefor. It should be understood that many changes, modifications, variations, and other uses and applications of the jaw and facial muscle exerciser apparatus will become apparent to those skilled in the art after considering this specification and the accompanying drawings. Therefore, any and all such changes, modifications, variations, and other uses and applications which do not depart from the nature and spirit of the invention are deemed to be covered by the invention which is limited only by the following claims.

Having thus described my invention, what I desire to claim and secure by Letters Patent is:

1. An exerciser apparatus for enabling the exercising of facial muscles through movement of the jaws, said apparatus comprising:

(a) a first arm formed of a relatively thin flat band having a first end and a second end, (b) a second arm formed of a relatively thin flat band having a first end corresponding to the first end of the first arm and a second end corresponding to the second end of the second arm, (c) pivot means between said first and second arms at a pivot point located at the second ends of said arms, said first ends to be engaged by the teeth or gingiva of a user, (d) a torque spring forming part of said pivot means connecting the second ends of said arms and being comprised of a plurality of 360° convolutions and each being comprised of a thin flat band configured to form the convolution, the end portion of the end convolutions being integral with the associated arms and which convolutions cause said arms to move in a first direction about the pivot means to an initial position when not engaged by the teeth or gingiva so that the first ends of the arms are capable of being biased in said first direction to a maximum separation created by the bias of said torque spring, and where the user attempts to move the arms away from the initial position in a second direction opposite to the first direction against the action of the torque spring by engaging the arms with the teeth or gingiva and squeezing them together thereby causing a torque force on the convolution of the spring tending to bias the arms back to the initial position, (d) a first arcuate somewhat cup shaped engaging element located on the first end of one of said arms, said first somewhat cup shaped engaging element opening upwardly and having a shape similar to the upper jaw and teeth arrangement to be engaged by the upper teeth or gingiva, said first engaging element having a somewhat resilient pad in the first somewhat cup shaped portion to be engaged by the lower ends of the upper teeth and (f) a second arcuate somewhat cup shaped engaging element located on the first end of the other of said arms, said second somewhat cup shaped engaging element opening downwardly and having a shape similar to the lower jaw and teeth arrangement to be engaged by the lower teeth or gingiva, said second engaging element having a somewhat resilient pad in the second somewhat cup shaped portion to be engaged by the upper ends of the lower teeth.

2. The exerciser apparatus of claim 1 further characterized in that the engaging elements have arcuate cup shaped portions which generally conform to the shape of the teeth and gingiva of a human being and are of a relatively rigid material.

3. The exerciser apparatus of claim 2 further characterized in that means is provided for adjusting the amount of force to overcome the action of said biasing means when said two engaging elements are squeezed together.

* * * * *